US005577947A

United States Patent [19]

Malloy et al.

[11] Patent Number: 5,577,947

[45] Date of Patent: Nov. 26, 1996

[54] SCENTED INK AND METHOD OF USE ON NOVELTY ITEMS

[75] Inventors: Gene Malloy, Kenosha, Wis.; Maureen Day, Florrisant, Mo.; Frank Fundaro, Staten Island, N.Y.; Lance Cvancara, Milwaukee, Wis.

[73] Assignee: Betallic, Inc., St. Louis, Mo.

[21] Appl. No.: 520,958

[22] Filed: Aug. 30, 1995

[51] Int. Cl.[6] ..... A63H 3/06; A63H 33/00

[52] U.S. Cl. ..... 446/220; 446/385; 446/491; 101/491

[58] Field of Search ..... 446/220, 221, 446/223, 226, 385, 491; 101/491

[56] References Cited

U.S. PATENT DOCUMENTS

| | | | |
|---|---|---|---|
| 2,578,425 | 12/1951 | Hershkowitz | 101/491 X |
| 2,618,892 | 11/1952 | Locks et al. . | |
| 2,922,252 | 1/1960 | Van Dam et al. . | |
| 3,400,890 | 9/1968 | Gould . | |
| 3,567,119 | 3/1971 | Wilbert et al. . | |
| 3,655,129 | 4/1972 | Seiner . | |
| 4,419,395 | 12/1983 | Sugimoto | 428/28 |
| 4,419,396 | 12/1983 | Sugimoto | 428/40 |
| 4,476,171 | 10/1984 | Takeuchi . | |
| 4,484,768 | 11/1984 | Norfleet . | |
| 4,514,423 | 4/1985 | Tezuka et al. . | |
| 4,528,226 | 7/1985 | Sweeny | 428/40 |
| 4,556,236 | 12/1985 | Scholz et al. . | |
| 4,696,844 | 9/1987 | Spector | 428/46 |
| 4,778,431 | 10/1988 | Dudley . | |
| 4,828,176 | 5/1989 | Crowe . | |
| 4,906,488 | 3/1990 | Pera | 426/573 |
| 4,927,400 | 5/1990 | Lovik . | |
| 5,018,974 | 5/1991 | Carnahan et al. | 434/98 |
| 5,023,118 | 6/1991 | Cheng . | |
| 5,037,343 | 8/1991 | Benites | 446/369 X |
| 5,093,182 | 3/1992 | Ross | 428/195 |
| 5,102,364 | 4/1992 | Kubiatowicz . | |
| 5,108,338 | 4/1992 | Margolis . | |
| 5,119,968 | 6/1992 | Palmer . | |
| 5,338,243 | 8/1994 | Kieves | 446/220 |

*Primary Examiner*—Robert A. Hafer
*Assistant Examiner*—D. Neal Muir
*Attorney, Agent, or Firm*—Howell & Haferkamp, L.C.

[57] ABSTRACT

A scented ink composition and method of printing are employed in applying a scented ink image to a novelty item. The scented ink composition comprises printing ink and concentrated fragrant oils mixed and used in flexographic printing of sheeting used to make balloons or to print images on novelty items.

4 Claims, 1 Drawing Sheet

SCENTED INK AND METHOD OF USE ON NOVELTY ITEMS

BACKGROUND OF THE INVENTION (1) Field of the Invention

The present invention relates in general to a scented ink composition and a method of printing a scented image on a novelty item with the scented ink composition to thereby create a scented novelty item. In particular, the present invention relates to printing scented images on balloons with a scented ink composition to thereby create a scented balloon.

(2) Description of the Related Art

Balloons are well-known, and have been for hundreds of years. They are used as toys, novelty items, gifts and decorations. Balloons come in various shapes and sizes and are adorned in various and sundry ways from simple words printed on the outer surface to detailed pictures printed thereon. Such balloons are given in combination with flowers or other trinkets, or alone, as gifts and memorabilia for various occasions.

In many instances, the design or images on the outer surface of the balloon correspond to the spirit of the occasion for which they are given. A few examples are a Valentine's Day balloon with a red heart or roses on the surface; a Halloween balloon with an orange jack-o-lantern design on the surface; or a Christmas balloon with an image of a Christmas tree on the surface.

Toy and display balloons have been made of many different materials including rubber, latex and metallized material such as nylon and mylar. Latex balloons, when filled with air, tend to deflate within several days and, when filled with helium deflate in less time since helium molecules are much smaller than the oxygen and nitrogen molecules of air. In an effort to prolong enjoyment and slow the deflation, balloons have been made of other non-porous or non-gas permeable materials or coated with gas impenetrable films. Deflation can be slowed down significantly by using metallized surfaces or polyethylene coatings on the inner surface of the balloons.

Attempts have also been made to impart a fragrance or scent to balloons. For example, in U.S. Pat. No. 4,828,176 to Crowe, a combination balloon valve assembly/scent tablet receptacle is disclosed. The Crowe invention relies on the emission of aromatic fragrances from a scent tablet, held in the valve assembly in the interior of the balloon, to the exterior via the gas permeable balloon material, to thereby create a scented balloon.

Unfortunately, the concept of employing a scented tablet in the interior of a balloon cannot be used in many types of balloons having enhanced impermeability due to the increased effectiveness of the gas impenetrable materials from which these balloons are made. In addition, balloons that require a separate valve device in the neck of the balloon for retaining a scented tablet increases the cost of manufacture and materials of these balloons. Thus, the changing characteristics of balloons to decrease their gas permeability have also removed the effectiveness of known balloons to emit a scent.

SUMMARY OF THE INVENTION

One object of the present invention is to give a balloon, having a printed image thereon, a scent corresponding to the image. It is a further object according to the present invention to provide such fragrance without major modification in the conventional procedure for manufacturing such balloons in order to minimize additional expense. This is accomplished, according to the present invention, by adding fragrant oil to the printing ink prior to printing the images on the balloons.

To create a scented balloon according to the present invention, one need only mix the appropriate fragrant oil for the desired scent with the selected printing ink. By adding the proper concentration of fragrant oil, the chemical properties and printing characteristics of the ink are maintained. In addition, the choice of scent for a given image is limited only by the imagination of the designer.

The scented ink composition can be applied to balloons using conventional printing methods currently used in the art by substituting scented ink for conventional printing ink. The scented ink is comprised of a mixture of conventional printing ink, well known and widely used in the art, with any of a number of widely available concentrated fragrant oils. The selected fragrant oil for the desired scent is added to the printing ink at a concentration of at least 4 percent by weight, but no more than 7 percent by weight.

After mixing, the scented ink solution is used in place of conventional printing ink in a flexographic printing press, and the press is operated in a normal fashion to print images on metallized nylon sheeting used to manufacture balloons. After printing the scented images onto the sheeting, the image is dried in the conventional manner and the material is wrapped in polyethylene for storage until used to manufacture the balloons.

In a further embodiment of the invention, it is an object of the present invention to create a scented balloon with a long shelf life and which will not lose its scent before it is purchased. After the printing process is completed as described above, the balloons are manufactured from the printed sheeting material. The uninflated balloons are then placed in sealed containers to prevent the depletion of the fragrance before the containers are opened. The balloons remain in their containers while offered for sale. When the sealed containers are opened, after the balloon is sold, the scent begins to be dispersed.

It is a further embodiment according to the present invention to utilize a transparent, lustrous ink coating on top of the scented image in order to slow the permeation rate of the fragrance. In this fashion, the fragrance is not quickly depleted even after the balloon is removed from the airtight package in which it is sold.

While the invention will be illustrated and described as embodied in a balloon with a single exterior surface, it is not intended to be limited to such detail, since various modifications and structural changes may be made without departing in any way from the spirit of the present invention. Any novelty item manufactured to accept a printed image can be scented by merely substituting the scented ink for conventional ink when printing the image.

Although the principal advantages and features of the invention have been described above, a greater understanding of the invention may be attained by referring to the drawing and the detailed description of the preferred embodiment which follow.

DESCRIPTION OF THE PREFERRED EMBODIMENT

Figure 1:
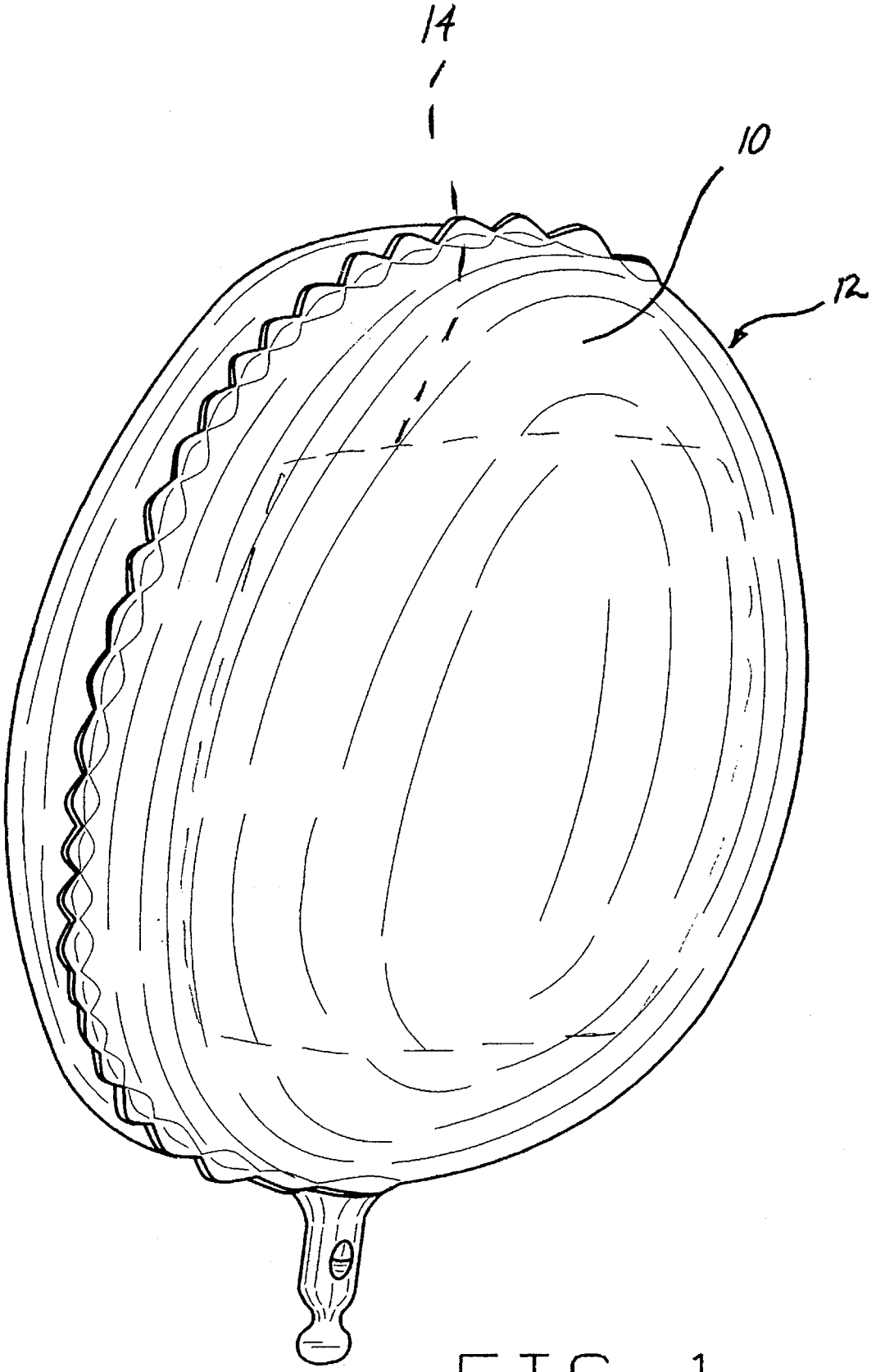
FIG. 1 is an isometric drawing of a sample metallized nylon balloon created in accordance with the principles of the present invention.

A scented ink composition used to print images on novelty items or balloons may be prepared by mixing a selected concentrated fragrant oil with any of the well known printing inks. Printing ink, as known in the art, is a mixture of carbon black, lampblack or other pigment, suspended in an oil vehicle, with a resin, a solvent, adhesive, and drier, available in many variations. The printing ink utilized herein is a two part solvent based blend consisting of 65 percent by weight of the ink base color mixed with 35 percent by weight oil vehicle. However, any type of acceptable printing ink may be used in the method and apparatus of the invention to be described.

The concentrated fragrant oils mixed with the ink according to the method of the invention may comprise natural or synthetic oils with different characteristics in chemical functionality, molecular weight, and volatility. Such fragrant oils are well known in the art and available in blends providing a wide variety of aromas. The fragrant oils used in the best mode of the present invention are primarily those designated in the art as highly concentrated "fine" perfumes, although other fragrant oils or fragrance materials may also be used without departing from the spirit of the invention.

To prepare the scented ink composition to be later applied to the exterior surface 10 of the balloon 12, a printing ink having the desired color and characteristics is first selected for the particular image to be printed on the balloon. The printing ink is prepared from the aforesaid list of ingredients in the normal and conventional manner known to those skilled in the art. After the ink is prepared, the selected concentrated fragrant oil for the particular scent desired of the balloon is added to and mixed with the printing ink. The amount of concentrated fragrant oil which is added is selected to maximize the fragrant emitting capabilities to the greatest extent possible without deteriorating the printing characteristics of the ink. It is beneficial to therefore utilize highly concentrated fragrant oils to provide a maximum permeability of fragrance without adding too high a quantity of fragrant oil to the ink, thereby diluting the printing properties of the ink.

Preferably, the concentration of the fragrant oil is between 4 and 7 percent by weight of the mixture. For example, if 100 pounds of printing ink are to be formed, approximately 4 pounds to 7 pounds of fragrant oil should be added to 93 to 96 pounds of printing ink. If less than 4 weight percent is added, the fragrance will not be sufficiently strong to fulfill the objects of the best mode of the present invention. On the other hand, if more than 7 weight percent is added, the fragrant oil becomes incompatible with the ink and begins to deteriorate the printing characteristics of the ink. For example, the inventors herein have found that the fragrant oil begins to interfere with the ink's ability to adhere to the metallized nylon sheeting if added to the ink in a proportion greater than 7 weight percent. Therefore, the range of fragrant oil added to the ink to achieve the desired result of a printable, fragrant ink is from 4 percent by weight to 7 percent by weight of the ink and fragrant oil mixture.

The inventors herein have not found it necessary to add other chemicals to induce dispersement of the fragrant oil throughout the ink in the preferred range of fragrant oil set forth above. The fragrant oil is merely added directly to the printing ink under agitation and mixed for at least 15 minutes. Moreover, no heat or pressure is necessary to aid in the mixture of the ink with the fragrant oil. The scented ink mixture can be adjusted to press viscosity as desired to increase or decrease the viscosity of the mixture by adding solvents as appropriate and necessary, as is well-known in the art. The inventors herein have successfully mixed fragrant oil in the fragrances of bubble gum, banana, baby powder, and rose scents with ink, but many other fragrant oils available in the art could be used to create an array of desired scents.

In the preferred embodiment of the invention constructed according to the preferred method of the invention, the scented ink is first used in printing a desired image on a sheet or web of textured nylon that is latter used to construct the balloon. The textured nylon sheeting used in the present invention is commonly available in rolls of approximately 20,000 linear feet. The sheeting is available with an aluminum coating previously applied to one surface of the sheeting. The application of the aluminum coating is well-known in the art, and this type of metallized nylon sheeting is readily available.

The first step in the preparation of the metallized nylon sheeting used in the construction of the scented balloon is the application of a coating of low density polyethylene, applied to a thickness of 0.65 mills, on the non-aluminized side of the sheeting. The polyethylene layer is applied through an extrusion process as is well known in the art. Pea size polymer resin beads are liquified under heat and pressure at a temperature between 600° and 630° fahrenheit. The liquified polymer is then coated onto the non-aluminized side of the nylon sheeting through conventional extrusion means with a long thin die. The polyethylene layer is then chilled within seconds after its application, thereby becoming a continuous film on the non metallized surface of the nylon sheeting. This produces a layered sheeting with the nylon center layer, the aluminum coating outer or external layer, and the polyethylene interior layer.

The application of the polyethylene film to the nonmetal side or interior surface of the sheeting enhances the ability of the balloon constructed from the sheeting to be gas impenetrable with the polyethylene interior layer forming an interior liner of the balloon. When the balloon is created, the polyethylene film layer of the sheeting becomes the interior of the balloon. Although the extrusion of the polymer film is used in the preferred embodiment of the invention to enhance the gas impenetrable characteristics of the balloons, it is not required to print a scented image on the metallized exterior surface 10 of the balloon 12. After the extrusion coating process, the sheeting is rerolled and stored for later printing. The rolls of metallized nylon can remain in storage for any length of time until they are needed for the printing process.

The application of the scented ink onto the metallized exterior layer of the sheeting is accomplished through flexographic printing, a printing process well-known in the art. Flexographic printing is a standard process wherein the ink is applied to rubber press plates which hold all or a part of the image design to be printed. The rolls of sheeting are placed on a continuous web flexographic printing press. The rubber press plates are supplied with the previously prepared scented ink in place of conventional printing ink, and the image is transferred onto the metallized side of the sheeting through pressure using conventional procedures for operating the press. After the scented ink is applied to the metal side of the sheeting, the image is dried in a conventional drying process using gas fired ovens as is well known in the art.

After the drying process is completed, the rolls of printed metallized nylon sheeting are wrapped in polyethylene film or shrink wrap to create an airtight seal around the roll. In this manner, the sheeting rolls maintain their scent while waiting to be used to make balloons.

The preferred embodiment of the invention also provides for slowing the permeation rate of the scented ink from the exterior surface of the balloon. Due to the small amount of fragrant oil in the extremely thin layer of ink applied to the balloon surface, there is a need to slow the permeation of the fragrance from the surface to make the scent last. The application of a composition comprising nitro cellulose, known in the art, acts as a transparent varnish over the scented ink and slows the permeation rate of the fragrance.

The application of the transparent coating layer over the printed layer of ink on the balloon exterior surface is also performed using the flexographic printing press. This step is performed prior to the drying process, and after the scented image has set a few seconds after its printing. The application of the transparent coating is performed in the same fashion as the application of the scented ink. However, a 100 percent cover printing plate is substituted for the image printing plates in the press. This ensures that the entire printed image on the exterior surface is covered with a transparent layer 14 of the varnish.

After the nylon metallized sheeting is printed in the steps outlined above, it is used in the balloon making process which is well-known in the art. The current invention also allows printing of multi-colored images on balloons by using different colored and scented ink on those applications as appropriate. For example, a balloon which has a two color design could use scented ink for the one portion of the image and conventional ink for remaining portions of the image, or scented ink in various colors to create a completely scented image. Other methods of application such as rod coating, extrusion, spraying, brushing, or curtain coating may also be used for the application of the scented ink or the transparent coating without deviating from the spirit of the invention. Although the present invention employs the scented ink composition to print scented images on sheets of metallized nylon, commonly used in the industry to form balloons, the sheeting can be any natural or synthetic material acceptable for making balloons which accepts printing ink thereon, such as latex, rubber, metallized nylon or mylar. Moreover, the application of scented ink is not limited to balloons. Any novelty item or toy or toy covering which accepts printing ink on its surface can be substituted for the balloons.

There are various changes and modifications which may be made to the invention as would be apparent to those skilled in the art. However, these changes or modifications are included in the teaching of the disclosure, and it is intended that the invention be limited only by the scope of the claims appended hereto.

What is claimed:

1. A fragrant scented balloon displaying a printed image thereon, the balloon comprising:

a sheeting surrounding an interior volume of the balloon, the sheeting having an interior surface within the balloon interior volume and an opposite exterior surface; and a fragrant scented ink comprised of a mixture of at least one fragrant oil and a printing ink applied to the exterior surface of the balloon, the fragrant scented ink permeating a fragrance, wherein the mixture comprises a range of four (4) percent by weight to seven (7) percent by weight of the fragrant oil to a total weight of the mixture.

2. The balloon of claim 1, wherein:

a transparent coating covers over the fragrant scented ink on the exterior surface of the balloon reducing a rate of permeation of the fragrance from the ink.

3. The balloon of claim 1, wherein:

a polyethylene film covers the interior surface of the sheeting.

4. The balloon of claim 1, wherein:

the exterior surface of the sheeting is a metallized film and the fragrant scented ink is applied to the metallized film.

* * * * *